33-241 SR
1/18/77 XR 4,003,507

United States Patent [19]
Elton

[11] 4,003,507
[45] Jan. 18, 1977

[54] NIGHT FIGHTER HOLSTER

[76] Inventor: Richard F. Elton, 2908 Roanoke Ave., Kettering, Ohio 45419

[22] Filed: Nov. 24, 1975

[21] Appl. No.: 634,650

[52] U.S. Cl. ..... 224/2 B; 224/5 H; 33/241

[51] Int. Cl.[2] ..... F41C 33/04

[58] Field of Search ..... 224/2 B, 2 C, 2 D, 1 R, 224/2 A, 5 H, 5 R, 5 A, 5 B, 5 V, 26 R, 28 R, 28 C, 25 R, 25 A; 33/242, 241, 243

[56] References Cited

UNITED STATES PATENTS

| | | | |
|---|---|---|---|
| 1,584,276 | 5/1926 | Coulter | 224/5 H |
| 2,246,174 | 6/1941 | Howells | 33/241 |
| 2,297,008 | 9/1942 | McMillan | 224/2 B |

*Primary Examiner*—Robert J. Spar
*Assistant Examiner*—Jerold M. Forsberg
*Attorney, Agent, or Firm*—Joseph Patrick Burke

[57] ABSTRACT

This disclosure is directed to a handgun holster capable of activating a light activatable, luminous material deposited on the rear surfaces of the front and rear sights, respectively, of the handgun without revealing the position of the party holding and aiming the piece at the critical time it is aimed thereby permitting handguns to be aimed accurately in the darkest conditions by peace officers without hazard. Basically the holster conforms in general contour and appearance to that of the handgun and contains a shielding portion and one or more lights of sufficient intensity to permit short duration light exposure during activation of the luminous material.

7 Claims, 5 Drawing Figures

FIG-1
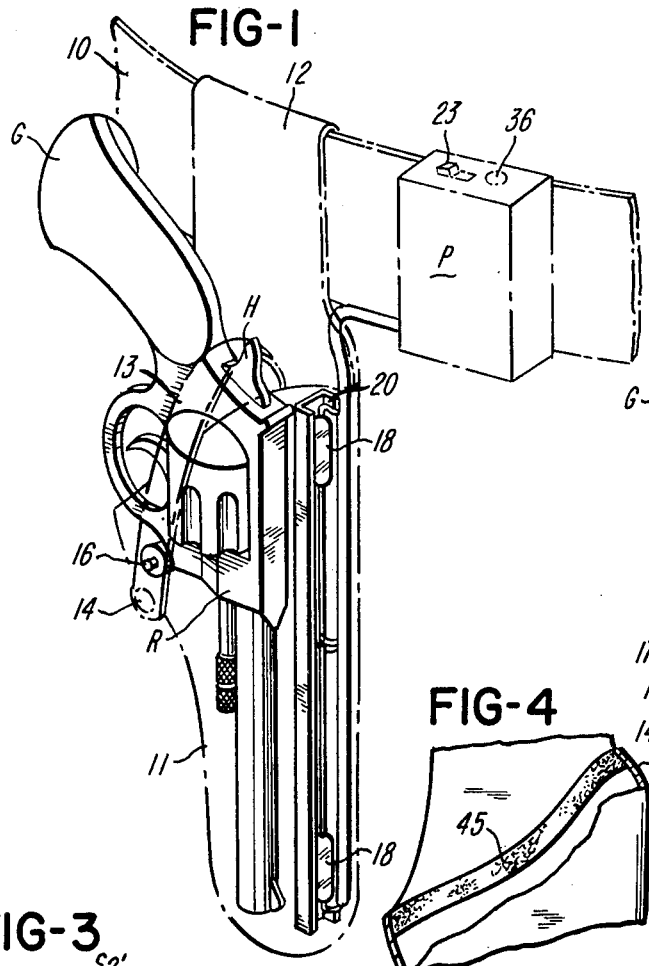
FIG-2
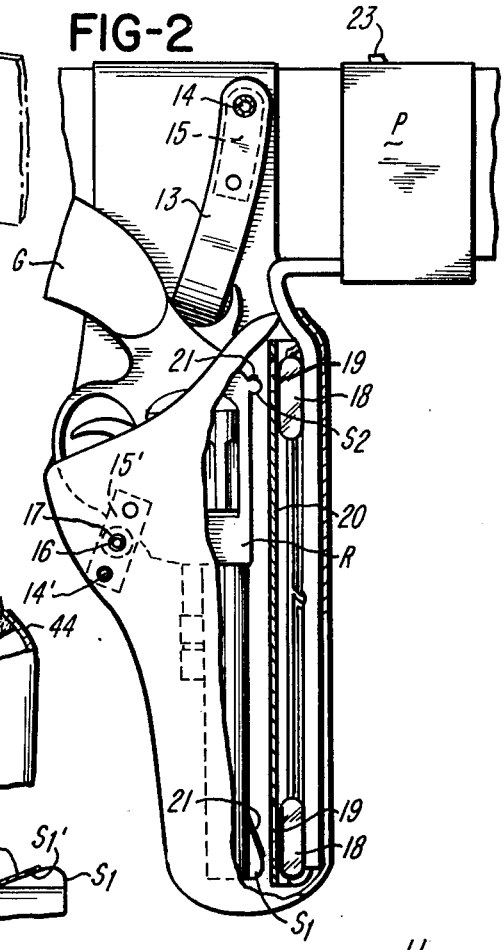
FIG-4
FIG-3
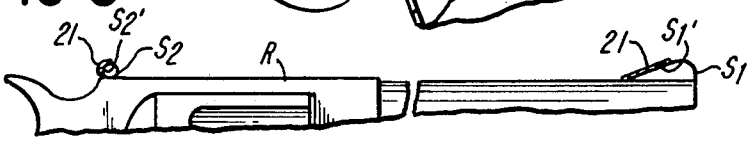
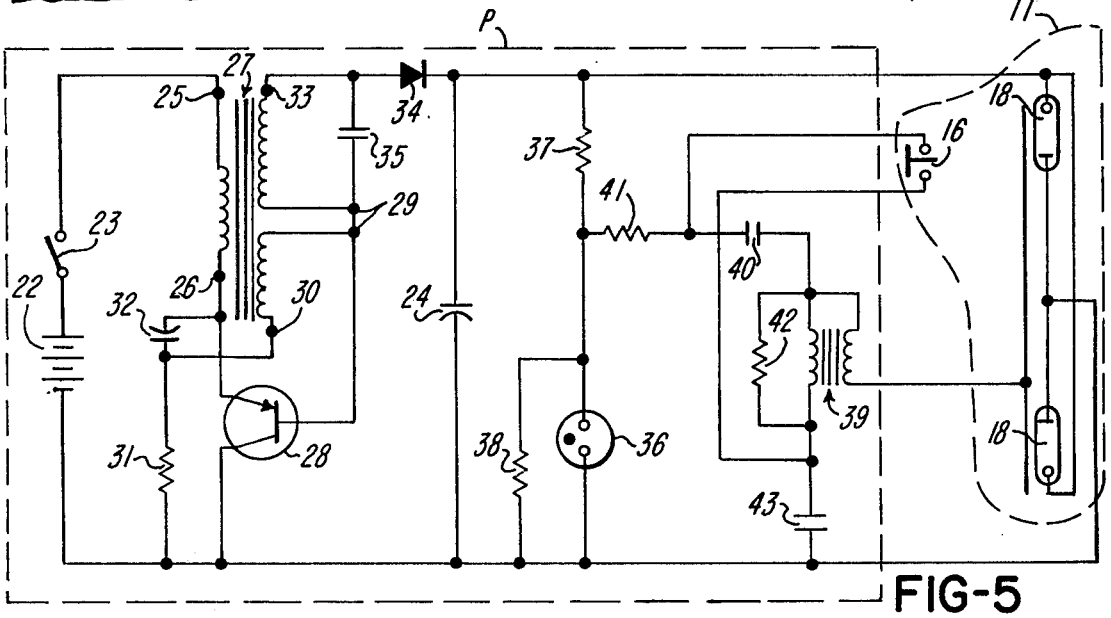
FIG-5

NIGHT FIGHTER HOLSTER

The present invention is directed to an improved holster which contains lighting exposure means in the form of one or more comparatively high-intensity short exposure duration lights, e.g., of luminous power or intensity similar to flashbulbs viz., those used in flashguns or blinker lights used by photographers to enhance lighting during photography. The light(s) are positioned interiorally within the holster in the forward inner portion which is adjacent to and faces the rear surface(s) of the front and rear sights of the handgun. The rearward surfaces of both the front and rear sights have applied thereto, e.g., by painting, the light-activatable, luminous material, viz., a material which when exposed to light of sufficient intensity (power or output), e.g., usually an intensity of from about 30 to about 90 lumen seconds per $ft^2$ (measured at a four foot distance using two fully charged 1.5 volt batteries arranged in series to constitute an electrical power source in an electronic arrangement as shown in FIG. 5). Upon activation for very short time periods, e.g., flash durations of one-three thousandths of one second, the luminous material will glow or become illuminated in the dark sufficiently to permit the holder to see and line up front and rear sights for aiming at the target. Typically the rearwardly illuminated front and rear sights should be sufficiently visible in the dark for comparatively short periods of time, viz., from about 0.5 to 4.0 minutes, depending on the extent of darkness, so as to enable the person holding the handgun to be able to sight it from back to front and aim, thereby determining in advance the direction which the bullet will take upon leaving the piece on its way to the target.

The external shape of the holster has the customary "handgun" holster outward appearance and conforms generally to that of the handgun, e.g., revolver or pistol placed therein and includes a cap portion or upper shielding member to shield the activating flash of comparatively high-intensity light while the handgun is still holstered. This has the affect of preserving the user's concealment security, which is extremely important in the case of peace officers investigating crime at night. Additionally, the present invention makes it possible for the peace officer to activate the sights on the piece slightly in advance of using it, e.g., while still in the police cruiser thereby obtaining further cover and concealment of his position while at the same time providing his handgun with a "night vision" capability.

It will be noted throughout this specification that the holster of this invention is used in combination with a handgun having the rear surfaces of the front and back sights provided with a light-activatable material capable of emitting light in the dark. One significant advantage of this holster-handgun relationship is that the holster provides the handgun with a "night vision" aiming capability without altering the handling, weight, or firing characteristics of the piece. The invention will be discussed in greater detail in conjunction with the accompanying drawings.

FIG. 1 of the drawings is a schematic view, partly in phantom, providing a view of a revolver-type handgun secured in the holster from a position above and to the right of the holster.

FIG. 2 is a frontal view, partly in section, of a portion of the handgun and the holster with the holster fastener unsnapped.

FIG. 3 is a partial side elevational view showing the upper portion of the handgun with the coating of light activatable luminous material located on the rear surfaces of the front and back sights, respectfully.

FIG. 4 is a frontal view, partly in section, of one embodiment wherein fur or other fibrous material is employed to act as a shield or barrier to substantially prevent light from the light source being seen at the holster top during activation of the luminous material.

FIG. 5 is a plan view of a typical electronic activator circuit with components for activating the luminous material.

BACKGROUND OF THE INVENTION

It is necessary for a police officer, sheriff, security guard or other peace officer to be able to aim a handgun accurately both in daytime and nighttime. In daylight and other light conditions sufficient to enable the police officer to see both the front and rear sights of his sidearm, no visual problem exists regarding aiming the piece. At nighttime or under darkened conditions, a problem arises because both front and rear sights cannot be seen.

One possible solution to this problem is to illuminate the sights by an auxilliary light source, such as a flashlight during aiming. However, the use of such a solution places the officer in danger because it makes the officer a lighted target in the dark destroying any concealment otherwise provided by the darkness.

Another characteristic practice for peace officers is to utilize a flashlight or other hand-held light, extended as far as possible from the body, while directing the light at the object which may be fired at. Although this procedure allows the officer to see the target, it still does not permit him to accurately aim and sight his gun under darkened inside or outside conditions. Such a use of flashlight becomes more of a handgun "pointing" operation rather than actually aiming the handgun using the front and rear sights thereof.

Another attempt at solving the problem of aiming a handgun in darkened conditions has been to equip a handgun with add-on device(s), e.g., for mounting a flashlight or other light thereon. In this operation, the peace officer is directing his gun whereever the light is pointed. Again, this becomes a "pointing" operation with very little ability to accurately sight the weapon. Further, the light source clearly identifies the location of the officer and makes him an extremely vulnerable target. Further the flashlight mount increases the weight and adversely affects the balance and handling of the handgun while rendering quick use of the weapon exceedingly difficult.

Still another approach to solution of this aiming in the dark problem resides in providing an add-on device or means positioned on or within a weapon to illuminate portions of the front and rear sights thereof. Examples of prior art attempts in this respect can be found in Kaltmann, U.S. Pat. No. 3,813,790, Hayward, U.S. Pat. No. 3,678,590 and Searcy U.S. Pat. No. 2,158,915. These patents relate chiefly to firearms of the rifle type and are not readily adaptable to use in short barreled firearms, such as handguns.

Still another type of device which has been proposed in the prior art for solution of this aiming problem involves the use of a light reflective material positioned, for instance, in the area of the front sight of a gun such as any available light impinging thereon will be concentrated and will render the front sight visible during periods of lower intensity light. Unfortunately, however, such devices do require some available light, viz., light from some external sources whether it be sun light or artificial light, in order to illuminate the front sight. For periods close to total darkness and investigations requiring police officers to enter darkened buildings to investigate burglaries and break-ins; these front sight luminescent illuminating devices, such as taught in Gangl, U.S. Pat. No. 2,822,616 offer little assistance in sighting or aiming of a handgun under darkened conditions. Considering daylight as a source of illumination, these types of devices may render a weapon useable for approximately an additional hour at sunrise and at sunset. No substantial increase in ability to sight or aim a handgun under darkened conditions will be provided in the darkest hours and in darkened interior conditions.

Other types of prior art devices, seeking to enhance the ability to sight a weapon accurately under darkened conditions, involve the use of a source of infra-red light with an infra-red scope sight. This type of equipment is expensive and bulky. Accordingly it does not offer a practical and economical solution to the problem of aiming handguns, such as those with which peace officers are equipped, under darkened conditions.

Still another approach to the problem of accurately sighting and aiming handguns at night is proposed by Knutsen et al, U.S. Pat. No. 3,641,676. The Knutsen et al patent teaches the use of so-called "encapsulated" devices incorporating radioactive, radioluminescent materials which are enclosed by, or incorporated within a plastic protective encapsulating medium. These radioluminescent materials are radioactive materials, however, such as radium, tritium and promethium-147 with or with a phosphor. These radio active materials are not only expensive, but are of the type which provide their own radioactive light and do not require any external (activating) light in order to illuminate handgun sights. The radioluminescent materials can be painted on the rear surfaces of the front and rear sights of a handgun followed by covering with a transparent plastic coating to provide protection to the radioluminescent coating. Alternatively radioluminescent material can be incorporated within a plastic shell thereby encapsulating it. In the latter case the radioluminescent add-on capsule(s) is (are) secured to the front and/or rear sights, respectively. The amount of light output available to illuminate the involved sight(s) is dependent upon the particular radioactive isotope selected and the amount thereof used. It is necessary to use sufficient amounts thereof to provide the desired light output recognizing that all radioactive materials undergo a continually increasing loss of radioactivity, including radio luminescence. This loss factor is known as the "half-life", which is specific to each radioactive isotope used. The use of radioactive materials, such as proposed in the Knutsen et al. patent carries with it some personal risk of increased exposure to radiation of a harmful type. Accordingly, elaborate encapsulation proposals are included in Knutsen et al in order to permit the utilization of minimal amounts of radio illuminescent material.

SUMMARY

Thus it will be observed that there is a present need in the art for a means to provide night illumination for the front and rear sights of a handgun sufficiently to enable a peace officer to aim the piece prior to firing same under totally darkened conditions. This objective must be achieved, however, in an economically feasible manner while avoiding bulky add-on devices which increase the weight of the handgun impair normal balance and handling characteristics while making it more difficult to utilize the piece rapidly as the need arises. All of these objectives must be accomplished with the paramount necessity of avoiding illumination of the peace officer or the handgun, thereby preserving the officer's concealment as afforded by darkness.

DETAILED DESCRIPTION OF THE PREFERRED EMBODIMENTS

The present invention utilizes light-activatable luminescent materials applied, e.g., by painting or coating, on the rear surfaces of the front and rear sights, respectively, of the handgun and provides for the activation thereof, while holstered with a high intensity light source. This activation occurs over a short period of time, e.g., one-three thousandth of one second, while the piece is still holstered thereby avoiding illumination of either the weapon itself, or the party sighting it during each time the luminescent material is activated. Since light-activatable luminescent materials are employed; there is no radiation hazard or personal danger to the health of the peace officer and no particular precautions are necessary in respect of applying the material to the appropriate rear surfaces of the handgun sights. Also there is no necessity to use minimal amounts only of light-activatable luminescent material. Additionally the luminescence can be restored by resubjecting the coatings to the high intensity light source (activation) within the holster.

The comparatively dark interior of the holster provides a virtually ideal location for activation of the luminescent material from the point of view of protecting the officer's concealment as afforded by darkness. In accordance with certain preferred embodiments of this invention, this darkened holster interior environment can be enhanced by placing additional shielding or masking material, e.g, fur or fabric in the upper portions of the holster at the locations where portions of the handgun, e.g., the handle, trigger guard and the hammer, are exposed to view. Similarly, since the activating light source(s) is incorporated in one or more locations in the interior of the holster, and disposed in such position and of such configuration as to occupy little space therein, the external appearance of such holsters do not readily reveal the fact of their capability to provide handguns with enhanced night aiming or sighting capabilities under virtually totally dark conditions.

The holster in accordance with this invention is one having one or more, and preferably two, self-contained, battery-operated light sources of comparatively high intensity yet operating for a short duration over repeated on-off cycles as controlled conveniently by the peace officer. Each such light source is capable of emitting light within the holster to one or both of the rear surfaces of the front and rear sights respectively. Each of said rear surfaces has been coated with a light-activatable luminescent material which after being exposed to light of sufficient intensity will thereafter glow in the dark. The light source(s) employed herein can be strobe lights of the same type or similar to those known as xenon flash tubes and used in photography. Thus it will be observed that such light sources concealed within the holster, itself, are "on" for extremely short periods and only in each user-controlled activation cycle.

As will be observed from FIG. 1, holster 11 has upper looped portion 12, which can be secured to a waist belt or shoulder harness. In FIG. 1, it is shown as looped for securing to a waist belt 10 worn by the peace officer. The holster has the outward appearances of a conventional handgun holster. Strap portion 13 restrains the revolver R within the receptacle well portion of the holster. The strap fits just behind the rear portion of the hammer H of the handgun between the hammer and the rearward face of the revolver grip G thereof. Located on strap 13 is a snap fastener female portion 14 which is secured to a corresponding snap fastener male portion 14', FIG. 2, located on the exterior wall of the holster. Mounted on the interior surface of strap 13 is a small rigid plate 15, FIG. 2, to impart stiffness to said strap thus enhancing contact with activating switch 16. A similar small rigid plage 15' having an opening 17 is secured to the outer holster surface. On closing (snapping) the fastener, plate 15 contacts switch 16, which is off when the holster strap fastener is snapped. Thus when the snap is unsnapped, and plate 15 is disengaged from activator switch 16, the switch is placed in the on or operating position causing the comparatively high intensity, short duration light sources 18 to come "on" immediately inside the holster thereby activating the luminous material 21 on rear surfaces $S_1'$ and $S_2'$ of the front and rear sights, $S_1$ and $S_2$ respectively (FIG. 3). The light from each light source 18 passes through openings 19 in channel 20 which is shown to be "U-shaped" in cross section. Openings 19 are shown in FIG. 2 whereas the cross sectional shape of channel 20 is apparent in FIG. 1.

This exposure within the confines of the interior of the holster is sufficient to activate or energize the light activatable luminescent material located at rear surfaces $S_1'$ and $S_2'$ to permit the peace officer to accurately view the front and rear sights and align them with the target for a brief but reasonable period of time subsequent to the removal of the handgun from the holster.

The electronic circuitry and components used in activating the light sources 18 are shown in FIGS. 1, 2 and 5 with most of the circuitry and components being located in holster belt mounted power pack P, the internal circuitry and components for which are shown in FIG. 5. Power pack P usually contains two or more 1.5 volt batteries constituting a power source 22 controlled by two position flip switch 23 located at the top of the power pack, which connects the batteries to a conventional oscillator-rectifier circuit (FIG. 5) of the general type described in Honeywell Photographic Products Division Technical Manual 73003 320-001A 3C of June, 1972 relating to AUTO/STROBONAR 460. The oscillator/rectifier circuit converts the low d-c voltage from the batteries to a high d-c voltage which is stored in a storage capacitor. Closing the flip switch 23 triggers the xenon flashtubes thus converting the stored energy into light.

OSCILLATOR CIRCUIT

Part of the energy stored in the batteries is transferred to the storage capacitor 24 and is stored in the capacitor at high voltage until it is used in the flashtubes. A forward drive oscillator, transformer and rectifier accomplish the energy transfer. The oscillator draws energy from the batteries and produces pulses which are suitable for a transformer input. The transformer converts the low voltage pulses to high voltage a-c and the rectifier converts the a-c to d-c for storage in the energy storage capacitor 24.

With switch 23 turned on, current from batteries 22 flows through the primary pins 25 and 26 of transformer 27, the emitterbase junction of transistor 28, pins 29 and 30 of transformer 27 and resistor 31. This current forward biases transistor 28 and allows primary current to flow from the batteries through pins 25 and 26 of transformer 27 and the emitter-collector of transistor 28. As current flow in 27 rises, a voltage is induced in the secondary of 27 pins 29 and 30 and capacitor 32 is charged to this voltage through the emitter-base junction of transistor 28. This charge current saturates transistor 28. The current level in the primary of transformer 27 continues to rise and the induced voltage on 27 (pins 33 and 29) causes a charge current to flow from that winding through diode 34, storage capacitor 24, batteries 22, flip switch 23, the primary of transformer 27 and the emitter-base junction of transistor 28.

This current charges capacitor 24 and supplies base drive to hold transistor 28 in saturation after capacitor 32 has charged to the voltage of pins 29 and 30 of transformer 27. Current in 27 primary continues to rise until it reaches a level for which the base drive can no longer keep transistor 28 saturated. At this time, the emitter-collector impedance of 28 increases, reducing current to pins 25 and 26 of 27. This reduced current causes the induced voltages of 27 secondary to reverse, effectively back biasing the emitter-base junction of transformer 28 thus turning it off. Transformer 27 voltages drop to zero and capacitor 32 discharges through resistor 31 and pins 25 and 26 to power source 22. When 32 has sufficiently discharged, the cycle is repeated.

Capacitor 35 provides a low impedance path for the core energy of 27 during flyback to protect the circuit from overvoltage due to the collapsing magnetic field of 27 when transistor 28 is cutoff.

The voltage induced in 27 secondary drives current through diode 34 to charge energy storage capacitor 24 during the portion of each oscillation that pin 33 of 27 is positive, providing 28 with increased base drive. A portion of the voltage across 24 is impressed across the neon ready light 36. Resistors 37 and 38 act as a voltage divider to establish the firing voltage of ready light 36. The neon lights when the unit reaches about 70% of full light output.

TRIGGER OUTPUT

The trigger circuit provides a high-voltage pulse to the exterior of the flashtubes. This pulse ionizes the xenon gas in the tubes, initiating a discharge path through the tube for the energy stored in capacitor 24.

Pulse transformer 39 is the flashtubes trigger coil which ionizes the gas in the flashtubes by impressing high voltage to the exterior of each flashtube. As storage capacitor 24 charges, capacitor 40 charges through 37, resistor 41, transformer 39 to the voltage across 36. When the open flash (activator) switch 16 contacts closes, 40 discharges through transformer 39 secondary, the high-voltage pulse necessary to ionize the gas in flashtubes 18, the flashtubes then flash (light). Flyback ringing is reduced by resistor 42. Capacitor 43 provides an a-c return path for the high voltage pulse.

In place of the pair of flashtube lights shown in the drawings, a single flashtube light can be used. Characteristically the full power light output ranges from about 75 to about 80 lumen seconds per $ft^2$ (measured at a four foot distance using a fully charged battery).

Since the luminous material located on the front sight $S_1$ and the rear sight $S_2$ is applied only to the rear surfaces of each sight, and the light activation thereof occurs within the interior confines of the holster; the peace officer is permitted to sight the handgun under the darkest possible conditions without revealing his position to the assailant or burglar.

It will be noted from FIG. 4 that holster cap portion 44 assists in shielding the light from observation prevents the predominant portion of the light emitted from being observed from the front of the holster. Further security can be provided to further restrict light emanating during activation of the luminescent material by employing fur or other fibrous material 45 in the form of an interior upper edge lining around the top periphery of the holster 11, as is apparent in FIG. 4.

What is claimed is:

1. A holster for activating light-activatable luminous material on the rear surfaces of the front and rear sights of a gun while it is holstered therein without revealing the position of the wearer during said activation comprising:

a receptacle well portion to house said gun, said well having a portion suitable for securing to a wearer's belt or harness;

a gun-restraining strap, one portion of which is secured to said well and another portion of which is fastenable to the outer surface of said well, at least one light source positioned within the interior of said well for activating said luminous material;

a portable electrical power source operatively connected to said light source to provide the power for illuminating said light source;

an activator switch on the exterior surface of said holster well and;

means connecting said activator switch to both said electrical power source and said light source, whereby upon fastening said holster strap to said holster well said switch is off and said light source is out and upon unfastening said strap from said well said switch activates said light turning it on and causing it to illuminate thereby causing activation of said luminous material within the confines of the interior of said holster well to an extent sufficient to permit illumination thereof in total darkness.

2. A holster as in claim 1 which includes a fibrous interior upper edge lining around the top periphery of said holster.

3. A holster as in claim 1 wherein said portable electrical power source and said means connecting said activator switch to both said electrical power source and said light source are contained within the same housing, said housing being located remote from said holster well.

4. A holster as in claim 1 which includes a plurality of light sources, each of which is comprised of a flashtube containing a gas capable of ionization when subjected to the discharge of an electric current through said tube.

5. A holster as in claim 1 wherein said fastenable portion of said gun-restraining strap contains a rigid plate to enhance contact of said activator switch and said fastener portion of said activator switch.

6. A holster as in claim 5 which includes a small rigid plate on the exterior surface portion of said holster well to enhance rigidity and prevent unwanted activation of said switch.

7. A holster as in claim 3 wherein said activator switch connecting means includes an additional switch to disconnect said electrical power source.

* * * * *